United States Patent [19]

Theurer

[11] Patent Number: 4,892,040

[45] Date of Patent: Jan. 9, 1990

[54] BALLAST TAMPING MACHINE

[75] Inventor: Josef Theurer, Vienna, Austria

[73] Assignee: Franz Plasser Bahnbaumaschinen-Industrie GmbH, Vienna, Austria

[21] Appl. No.: 196,672

[22] Filed: May 20, 1988

[30] Foreign Application Priority Data

Mar. 8, 1988 [AT] Austria ..... 613/88

[51] Int. Cl.[4] ..... E01B 29/10

[52] U.S. Cl. ..... 104/6; 104/9; 104/12

[58] Field of Search ..... 104/5, 6, 9, 10, 12, 104/2, 7.1, 7.2

[56] References Cited

U.S. PATENT DOCUMENTS

| | | | |
|---|---|---|---|
| 952,378 | 3/1910 | Stephens | 104/9 |
| 1,595,420 | 8/1926 | Robb | 104/9 |
| 2,596,823 | 5/1952 | Richardson | 104/2 |
| 2,818,820 | 1/1958 | Williams | 104/9 X |
| 2,996,016 | 8/1961 | Keller | 104/12 |
| 3,260,218 | 7/1966 | Pyke | 104/9 |
| 3,537,400 | 11/1970 | Taylor | 104/9 |
| 4,133,266 | 1/1979 | Taylor | 104/6 X |
| 4,165,694 | 8/1979 | Theurer | 104/7.2 |
| 4,421,034 | 12/1983 | Allmer | 104/9 |
| 4,476,786 | 10/1984 | Theurer | 104/12 |
| 4,534,295 | 8/1985 | Theurer | 104/7.2 |

FOREIGN PATENT DOCUMENTS

| | | | |
|---|---|---|---|
| 466400 | 1/1975 | Australia | 104/9 |
| 893956 | 10/1953 | Fed. Rep. of Germany . | |
| 2119164 | 4/1971 | Fed. Rep. of Germany | 104/9 |

*Primary Examiner*—Johnny D. Cherry
*Assistant Examiner*—Joseph D. Pape
*Attorney, Agent, or Firm*—Kurt Kelman

[57] ABSTRACT

In a mobile machine for tamping ballast under ties of a railroad track, which comprises a machine frame, spaced undercarriages supporting the machine frame for mobility on the railroad track in an operating direction, and a ballast tamping assembly mounted on the machine frame and comprising a vertically adjustable tamping tool carrier, a drive for vertically adjusting the tamping tool carrier, pairs of vibratory and reciprocatory tamping tools immersible in the ballast upon vertical adjustment of the tamping tool carrier, and drives for vibrating and reciprocating the tamping tools: a first device associated with the ballast tamping assembly for gripping and transversely positioning a respective one of the ties, the first device including a drive for vertically adjusting the device, and a second device operable independently of the first device for transversely displacing a respective one of the ties, the second device including a drive for vertically and transversely adjusting the second device.

14 Claims, 2 Drawing Sheets

BALLAST TAMPING MACHINE

BACKGROUND OF THE INVENTION

1. Field of the Invention

The present invention relates to a mobile machine for tamping ballast under ties of a railroad track, which comprises a machine frame and spaced undercarriages supporting the machine frame for mobility on the railroad track in an operating direction. The ballast tamping machine has a ballast tamping assembly comprising a vertically adjustable tamping tool carrier, a drive for vertically adjusting the tamping tool carrier, pairs of vibratory and reciprocatory tamping tools immersible in the ballast upon vertical adjustment of the tamping tool carrier, and drives for vibrating and reciprocating the tamping tools.

2. Description of the Prior Art

The ties of a railroad track consisting of two rails fastened to the ties must rest on a well tamped ballast support so that the track retains its desired level and line whereby the quality and the life of the track is enhanced and extended. For this purpose, mobile track tampers of the above-indicated type are used to tamp the ties with tamping tools immersed in the ballast at each longitudinal side of the tie to the left and the right of each rail while the tamper advances intermittently from tamping stage to tamping stage or, in a more recent development of the art, continuously. Preferably, the track is leveled and lined at the same time so that the ties are tamped when the track is in a desired position. U.S. Pat. No. 4,534,295, dated Aug. 13, 1985, discloses a track tamping, leveling and lining operating unit incorporating such a ballast tamping assembly and a track leveling and lining assembly, which comprises a common carrier frame supporting the assemblies, a rear end of the carrier frame being supported on flanged wheels on the railroad track while a front end is linked to a track working machine. However, many types of smaller ballast tamping machines without leveling and lining tools and reference systems are known for minor track rehabilitation work. One such machine having ballast tamping assemblies of the above-indicated type associated with each rail has been disclosed in U.S. Pat. No. 4,476,786, dated Oct. 16, 1984.

Particularly when tamping branch tracks or railroad tracks other than main lines, some ties are obliquely positioned with respect to the rails or are entirely detached therefrom, the rail fastening elements having become loose due to the repeated vibrations to which passing trains subject the track and particularly because the tie wood has rotted, and sometimes because of uneven ballast tamping. Because of the non-uniform spacing of such ties and their lack of parallel alignment with respect to the adjacent ties, it takes longer to tamp these ties individually, and various auxiliary devices, such as tie transport and alignment machines and rail fastening machines, are needed unless the entire track is rehabilitated. In such a general track rehabilitation, damaged ties are exchanged for new ties with special tie exchange apparatus to maintain branch tracks in railroad stations, for example. Such rehabilitation work has to be completed by tamping the replaced ties and then leveling and lining the track with a leveling, lining and tamping machine. Such a replacement of damaged ties is required particularly where spikes are used for fastening the rails to the ties, the indicated problems being aggravated by the fact that rail spikes tend to become loose more readily.

U.S. Pat. No. 4,165,694, dated Aug. 28, 1979, discloses a mobile track leveling, lining and tamping machine which is preceded by a ballast plow arranged to move ballast from the shoulders into the cribs so that there will be sufficient ballast available for the succeeding tamping tools to tamp under the ties whereby a high-quality ballast support is provided for the corrected track. Whether large or small tampers are used and whether the tampers have a relatively high or low efficiency and accuracy, ballast plows have often been used in conjunction therewith, in many instances on independent, self-propelled vehicles. With smaller tamping machines, it is often uneconomical to use relatively large and expensive independent ballast plow machines.

During track rehabilitation work including tie tamping, it has been common practice to replace damaged or mispositioned ties, whose spikes have become loose, by withdrawing such ties from the track and inserting new and properly positioned ties. In copending U.S. application Ser. No. 165,510, filed Mar. 8, 1988, it has been proposed to equip a mobile ballast tamping machine of the first indicated type with a vertically adjustable device associated with the ballast tamping assembly for gripping and transversely positioning a respective tie. This device includes a drive for vertically adjusting the device.

SUMMARY OF THE INVENTION

It is the primary object of this invention to provide a ballast tamping machine of this type with the capability of rapidly tamping the track without interruption even if some of the ties are obliquely positioned or loose.

The above and other objects are accomplished in such a mobile ballast tamping machine according to the present invention by combining a first device associated with the ballast tamping assembly for gripping and transversely positioning a respective one of the ties, the first device including a drive for vertically adjusting the device, and a second device operable independently of the first device for transversely displacing a respective one of the ties, the second device including drive means for vertically and transversely adjusting the second device.

Such a ballast tamping machine combined in a simple manner with tie positioning devices enables individual ties, even if they are loose, to be correctly positioned before tamping with the same machine and during the same operating stage so that it is no longer necessary first to use a tie exchange machine, which is time-consuming and expensive.

Furthermore, this machine makes it possible rapidly to exchange damaged ties for new ties during the tamping operation in a very efficient and cost-effective manner, the new ties being immediately tamped with the same machine. Thus, this single machine can be used for the entire track rehabilitation work with a greatly reduced operating crew. At the same time, the tie positioning device enables all the ties to be exactly oriented perpendicularly to the track rails. In this connection, it is of particular advantage that these correctly positioned ties are immediately tamped in a single operating stage and fixed in position without being dislocated during intervening operations. The second device makes it possible to effectuate the initial displacement stroke when a new tie is to be inserted, which requires considerable force, while the final positioning is effectuated by the first device which exactly aligns the tie while it is being tamped.

But such a ballast tamping machine incorporating a vertically adjustable tie gripping and positioning device is particularly useful as the last stage of a tie replacement operation in which preceding tie exchange devices have removed old ties and replaced them with new ties, these newly inserted ties then being properly positioned before they are tamped. However, it may also be effectively used during a tie tamping operation when a damaged tie or a tie whose spikes have become loose and which, therefore, has been displaced is discovered. In this case, such a tie may be properly repositioned before tamping or even be entirely withdrawn and replaced by a new tie before tamping. Particularly where only a few ties are damaged or mispositioned, the ballast tamping machine of the invention will be very effective since it does away with the expensive use of a complex tie replacement apparatus. The properly positioned tie may be immediately tamped in a single operating stage.

The above and other objects, advantages and features of this invention will become more apparent from the following detailed description of certain now preferred embodiments thereof, taken in conjunction with the accompanying, somewhat schematic drawing.

DESCRIPTION OF THE PREFERRED EMBODIMENTS

Figure 1:
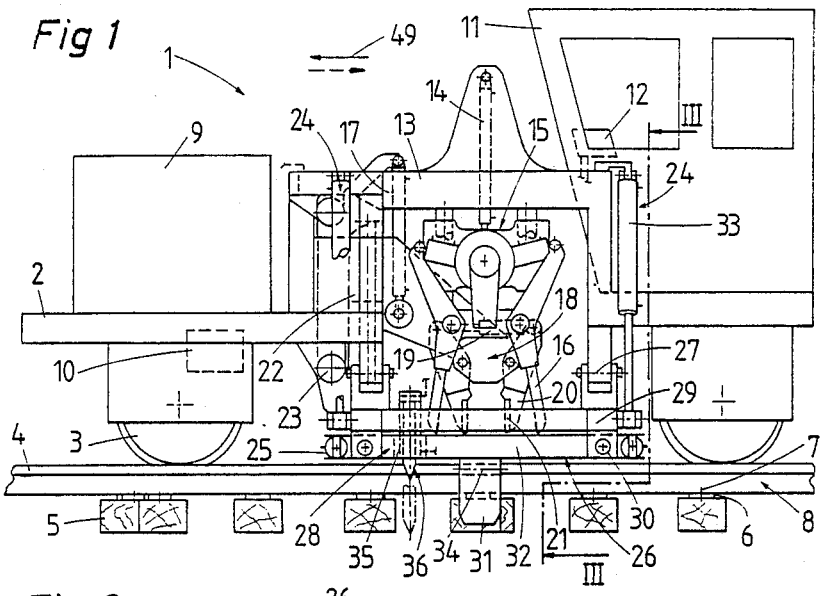
FIG. 1 is a side elevational view of one embodiment of the mobile ballast tamping machine with tie positioning devices according to the present invention.
Figure 2:
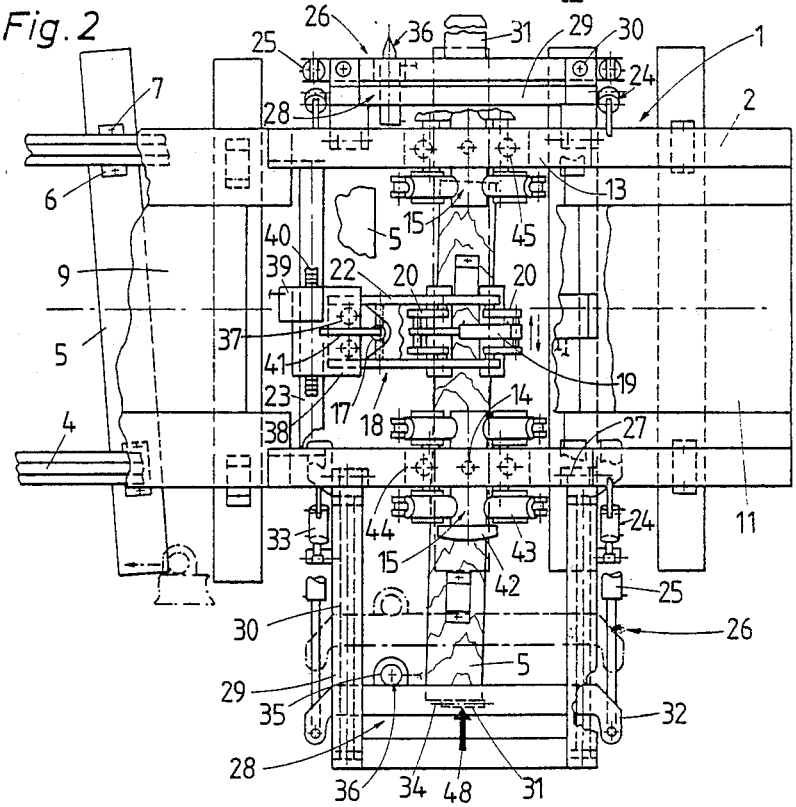
FIG. 2 is a top view of FIG. 1.
Figure 3:
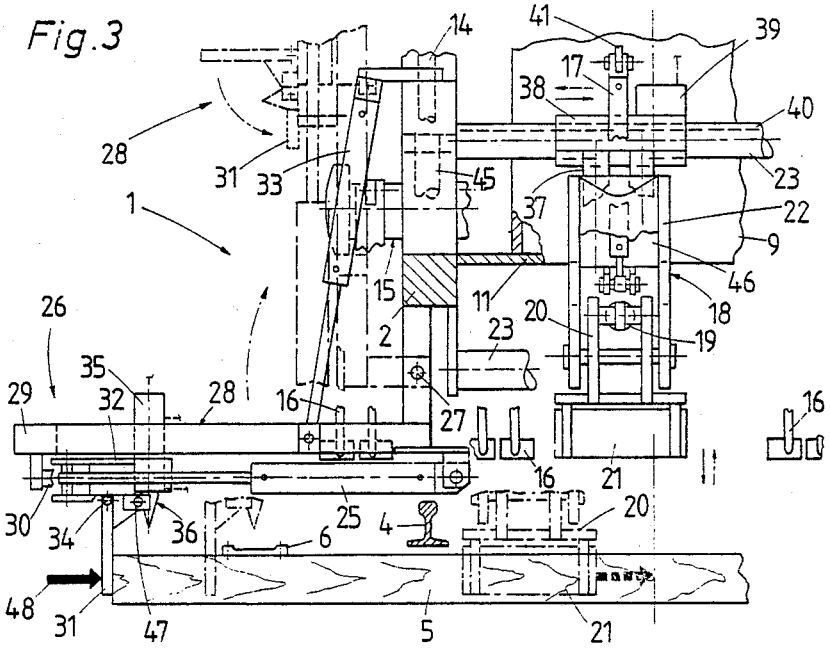
FIG. 3 is an enlarged cross sectional view of the machine, taken along line III—III of FIG. 1.

Referring now to the drawing and first to FIGS. 1 to 3, there is shown mobile machine 1 for tamping ballast under ties 5 of railroad track 8 whose rails 4 are fastened to the ties by tie plates 6 and bolts or spikes 7. The machine comprises machine frame 2 and spaced undercarriages 3 supporting the machine frame for mobility on railroad track 8 in an operating direction indicated by arrow 49. The machine has its own drive 10 receiving power from power plant 9 and carries operator's cab 7 housing control panel 12 for operating the machine drive as well as the drives for the various operating tools. Respective ballast tamping assembly 15 is associated with each rail 4 of track 8. Each ballast tamping assembly is mounted in upwardly recessed machine frame portion 13 and comprises a tamping tool carrier vertically adjustable on the machine frame by drive 14, pairs of vibratory and reciprocatory tamping tools 16 immersible in the ballast upon vertical adjustment of the tamping tool carrier, and drives for vibrating and reciprocating the tamping tools. All of this structure is conventional. Vertically adjustable device 18 for gripping and transversely positioning a respective tie 5 is associated with ballast tamping assemblies 15 and drive 17 is arranged for vertically adjusting the device.

As shown in the drawing, device 18 comprises positioning tongs 20 pivotal about an axis extending transversely to railroad track 8 for gripping a respective tie 5 and a power drive, such as a hydraulic motor, is linked to the tongues for pivoting them to grip the ties. Pressure plates 21 are mounted at the lower ends of gripping tongs 20 and extend parallel to each other transversely to the track for grippingly contacting the longitudinal sides of ties 5. Such an arrangement with relatively wide and robust pressure plates gripping the ties therebetween enables the gripped ties to be essentially automatically aligned perpendicularly to the track. Carrier frame 22 for gripping tongs 20 of first device 18 is connected for vertical adjustment to vertical adjustment drive 17 and is transversely displaceably guided on transverse guides 23 of machine frame 2.

Tie gripping and positioning device 18 is mounted on the machine frame between ballast tamping assemblies 15, pivotal tie gripping tongs 20 and the pairs of tamping tools 16 being arranged symmetrically with respect to a transversely extending, vertical plane of symmetry extending transversely of railroad track 8. The symmetric arrangement of the tie gripping tongs and tamping tools assures the automatic centering of the tamping tools with respect to the gripped and repositioned tie.

The machine of the present invention combines a second device 26 operable independently of first device 18 with the first device for transversely displacing a respective tie 5, the second device including drive means 24, 25 for vertically and transversely adjusting the second device. Second device 26 comprises flap 28 pivotal about axis 27 extending in the direction of railroad track 8 and arranged along a side of machine frame 2. Plate 31 is connected to the pivotal flap and is arranged for contacting, and press against, an end face of a respective tie 5. Displacement drive 25 is arranged to displace plate 31 in the longitudinal direction of the ties, and power drive 24 constituted by hydraulically operated cylinder-piston drive 33 connects flap 28 to machine frame 2 for pivoting the flap about axis 27. In the illustrated embodiment, pivotal flap 28 comprises U-shaped carrier frame 29 having two free leg ends linked to machine frame 2 at axis 27 and two guide posts 30 extending perpendicularly to axis 27 in a plane defined by carrier frame 29. Intermediate frame 32 is longitudinally displaceably mounted on guide posts 30, plate 31 and displacement drive 25 being connected to intermediate frame 32. Hydraulically operated pivoting cylinder 33 links carrier frame 29 to machine frame 2. Providing a pivotal flap for second device 26 for transversely displacing the ties produces a particularly simple structure and enables the device to be rapidly moved between a lowered operating position and an upwardly pivoted rest position during the movement of the machine between operating sites. The longitudinal displacement of the pressure plate 31 makes it possible to apply considerably displacement pressure on the end face of the tie for rapid insertion or withdrawal. The pivotal arrangement also enables the device to be rapidly and simply moved out of the way of any obstacles encountered along the track shoulder. The U-shaped structure of carrier frame 29 supporting longitudinally displacement intermediate frame 32 produces a very robust pivotal flap able to withstand considerable stresses. The two-point pivoting link attaching the carrier frame to the machine frame assures high resistance against torsional deformations.

Tie end face contact plate 31 is centrally affixed to intermediate frame 32 and a respective displacement drive 25 is connected to respective ends of the intermediate frame. The displacement drives are hydraulically operated cylinder-piston drives, the pistons of the drives being connected to the intermediate frame ends and the cylinders being connected to carrier frame 29 adjacent pivoting axis 27. Plate 31 is mounted on intermediate frame 32 pivotal about axis 34 extending in the direction of the railroad track. The power drives for pivoting flap 28 are so arranged that device 26 may be pivoted into the desired operation position without interfering with the operating of the ballast tamping tools. The arrangement of displacement drives 25 at respective sides of centered pressure contact plate 31 enables the plate to transmit transverse displacement pressure against the contacted tie end without torsion and in a straight line. The pivotal arrangement of plate 31 enables the same to be pivoted into a plane extending parallel to the plane of flap 28 when the machine is moved between operating sites. This avoids any undesirable lateral projection of the plate and thus avoids possible accidents or injuries to operating personnel.

As shown in the drawing, vertically adjustable wedge-shaped and pointed orienting tool 36 is mounted on intermediate frame 32 of second device 26 for transversely orienting obliquely positioned ties 5 perpendicularly to track 8, as schematically indicated in chain-dotted lines in FIG. 2. This arrangement makes it possible in a very simple manner to orient obliquely positioned ties so that they assume at least approximately the desired orientation perpendicularly to the track rails, the mounting of orienting tool 36 on intermediate frame 32 enabling the tool to be selectively displaced transversely for proper location with respect to the tie to be oriented. This further enhances the production rate of the machine, the vertical adjustment of the tool by hydraulically operated cylinder drive 35 enabling the tool to be operated by remote control without interference with the other operations of the machine.

As best shown in FIG. 2, two ballast tamping assemblies 15 are mounted on machine frame 2 and each ballast tamping assembly is associated with a respective rail 4 of track 8. The two ballast tamping assemblies define a transversely extending vertical plane of symmetry between pairs of tamping tools 16, and first and second devices 18 and 26 are arranged in the plane of symmetry adjacent the tamping tool carrier. Second device 26 comprises respective flap 28 pivotal about axis 27 and arranged along a respective side of machine frame 2 and a respective plate 31 is connected to each pivotal flap 28 for contacting a respective end face of a tie 5. Respective displacement drives 25 displace each plate in the longitudinal direction of the ties, and respective power drives 24 connect each flap 28 to machine frame 2 for pivoting the flaps independently about axes 27. The pivotal flaps extend in a cross sectional plane extending perpendicularly to railroad track 8. Pivotal flaps 28 at the opposite sides of machine frame 2 are arranged symmetrically with respect to ballast tamping assemblies 15 and first device 18 which is arranged between the two oppositely positioned pivotal flaps of second device 26. While one of flaps 28 is pivoted into its lowered operating position, opposite flap 28 is in its upper rest position.

The symmetric arrangement described hereinabove and illustrated in FIG. 2 advantageously centers the respective ties with respect to the tamping tools and the tie positioning devices so that each tie can be properly positioned and fixed in this position by tamping. This is done in a single operating stage and without moving the machine so that the efficiency of the operation is considerably increased. Providing independently operable pivotal flaps at each side of the machine frame substantially enhances the adaptability of the machine to various operating conditions and makes insertion or withdrawal of ties possible from either side of the track so that the machine may be operated regardless of any obstacles encountered on one of the track shoulders. It is also possible to use the pivotal flap at one side for displacing an old tie transversely to the other side of the track while the other flap is used to insert a new tie. Arranging the oppositely arranged pivotal flaps of second device 26 in a cross sectional plane extending perpendicularly to the railroad track makes it possible to center both flaps in the desired position without advancing the machines several times. The symmetrical arrangement not only centers all operating tools automatically with respect to each tie to be tamped but also improves the viewing of all the operations by the operator at control panel 12.

First tie gripping and positioning device 18 has a carrier frame 22 vertically displaceably mounted by two bearings 38 on two vertical guide posts 37. Bearings 38 are transversely displaceably mounted on transverse guide posts 23. Hydraulically operable transverse displacement drive 39 is affixed to upper bearing 38, the drive comprising a pinion meshing with transversely extending rack 40 extending along guide post 23. Vertical adjustment drive 17 for device 18 is connected at linking point 41 of upper bearing 38. Each ballast tamping assembly 15 has a tamping tool carrier 44 which is vertically displaceably mounted on vertical guide posts 45 affixed to machine frame portion 13, and vibrating and reciprocating drives 42, 43 operate tamping tools 16.

FIG. 3 clearly illustrates the relatively wide construction of gripping plates 21 of the two tie positioning tongs 20 of first device 18, which assures the automatic orientation of the gripped tie perpendicularly to track rails 4 when tie 5 is clamped between the gripping plates. The lower end of vertical adjustment drive 17, i.e. the outer end of its piston rod, is connected to vertically adjustable guide block 46 which is vertically displaceably mounted on guide posts 37, and carrier frame 22 of gripping tongs 20 is affixed to the guide block.

Pressure plate 31 of second tie positioning device 26 has a bolt 47 for fixing this plate in a plane enclosing an angle of 90° with the plane of the carrier frame. The direction of insertion of tie 5 by device 26 is indicated in FIG. 3 by arrow 48.

The operation of machine 1 illustrated in FIGS. 1 to 3 will be described hereinbelow:

Drive 10 is actuated to move ballast tamping machine 1 to an operating site while the two pivotal flaps 28 at the sides of machine frame 2 are pivoted into their upper rest position (shown on top of FIG. 2). At the same time, as shown in dash-dotted lines in FIG. 3, tie end contacting plates 31 are also pivoted about axis 34 into a plane extending parallel to the carrier frame of device 26. When the operating site is reached, a respective pivotal flap 28 (the lower one shown in FIG. 2) is lowered into its operating position by operation of power drives 24, in which position carrier frame 29 extends substantially parallel to the plane defined by track 8. This pivoting movement is effectuated at a point where a damaged old tie had been previously removed by one or two operating crew members or by the machine itself and where a new tie 5 has been placed in position for insertion into track 8. The slightly inserted new tie is now pushed into the track by lowered flap 28 in the following manner: plate 31 is fixed in its perpendicular operating position by set bolt 47 and the two longitudinal displacement drives 25 are actuated to move the fixed plate into pressure contact with the adjacent end face of new tie 5, and the displacement drives are operated to displace intermediate frame 32 along guiding posts 30 so that the new tie is transversely displaced for insertion into railroad track 8. As the tie is pushed further into the track, the opposite tie end comes into gripping range of pivotal tongues 20 of first tie positioning device 18 which is vertically and transversely positioned by drives 39 and 17 to enable the tongues to contact the longitudinal sides of tie 5, whereupon drive 19 is actuated to pivot the tongues into gripping position. The gripping contact of plates 21 of tongs 20 will automatically orient new tie 5 so that it extends perpendicularly to track rails 4. Transverse displacement drive 39 is now actuated so that new tie 5 will be effectively and rapidly inserted in the direction of arrow 48 by the combined operation of pivotal flap 28 and positioning tongs 20 until the tie has assumed its desired position with respect to the track rails. In this desired end position, tie 5 is pressed by means of gripping tongs 20 against the undersides of rails 4 so that the base of the rails comes to rest in the conforming recess in tie plates 6. Meanwhile, vertical adjustment drives 14 are actuated to lower ballast tamping assemblies 15 so that the tamping tools 16 are immersed in the ballast under inserted tie 5, and vibrating and reciprocating drives 42, 43 are actuated to operate tamping tools 16 for tamping ballast under the inserted tie while pressing it further against the undersides of the rails. In this manner, the inserted tie is fixed in its correct position with respect to track rails 4 so that it will remain in this position after gripping tongs 20 have been released and without immediately fastening the rails to the tie.

Tamping machine 1 may also be used for the removal of an old, damaged tie. In such an operation, as shown in FIG. 2, first tie gripping and positioning device 18 is transversely displaced into an outer end position and old tie 5 is gripped by pressing plates 21 of tongs 20 against the free longitudinal sides of the tie. Transverse displacement drive 39 is now actuated in a direction opposite to that indicated by arrow 48 to push old tie 5 out of the track. As soon as the opposite end position of device 18 has been reached, tongs 20 are released from the gripped tie and device 18 is returned to its initial end position where the tongs are again pivoted to grip the tie and the transverse displacement is repeated to push the tie further out of the track. As soon as this stepwise transverse displacement has pushed old tie 5 out of track 8 by about half its length, the further tie withdrawal movement may be effected by tie orienting tool 36. For this purpose, tamping machine 1 is moved a little along the track until tool 36 is aligned above the half-withdrawn tie. Flap 28 is then lowered so that the pointed end of orienting tool 36 becomes anchored in wooden tie 5. Actuation of longitudinal displacement drive 25 will then enable tool 36 to pull the tie entirely out of the track.

In the track section shown in FIG. 2, the succeeding tie is in working order so that it need not be repositioned. Next tie 5 (the penultimate one from the left in FIG. 2) has become detached from both rails 4 and has slipped to the side a little in the course of time. However, the tie itself can still be used and the two tie plates 6 are still fastened to the upper side of the tie. As soon as tamping machine 1 has advanced to this tie, it is gripped by tongs 20 of tie positioning device 18, the pressing contact of plates 21 with the longitudinal sides of tie 5 automatically causing the tie to be correctly aligned perpendicularly to the track rails. Transverse displacement drive 39 is then actuated to displace device 18 with the gripped tie transversely until the base of rails 4 is received in the conforming recess of tie plates 6. The succeeding tamping of the repositioned tie and the slight lifting of gripping tongs 20 will press the gripped tie against the underside of the rail bases so that the tie will be fixed in the correct position even before the rail fastening elements are attached.

The last tie 5 at the left of FIG. 2 has become detached and assumed an oblique position. In a first operating step, this tie is coarsely oriented by tie orienting tool 36. For this purpose, hydraulic drive 35 is actuated to lower the tool while flap 28 is pivoted downwards into its operating position so that tool 36 will contact a longitudinal side of tie 5 in the narrowest part of the crib (see dash-dotted lines). The machine is now advanced a short distance to cause tool 36 to push the contacted end of obliquely positioned tie 5 forward in the operating direction of the machine whereby the tie will be straightened while any ballast in front of the tie end will be pushed along. This coarse orientation of the tie is followed by a fine orientation by means of positioning tongs 20 of device 18 which will automatically position the tie perpendicularly to the rails when plates 21 on the tongs are pressed against the longitudinal sides of the tie. After the tie has thus been correctly positioned, it is tamped.

As the machine advances along railroad track 8 in the operating direction indicated by arrow 49, first and second tie positioning devices 18 and 26 as well as tie orienting tool 36 will be selectively operated in the above-indicated manner, depending on the required operation, and the correctly positioned ties will be tamped, all with the same machine and with a minimum of work in a minimum of time. The loosened or missing rail fastening elements may then be tightened or attached in a subsequent operation.

The upwardly pivoted flap 28 shown in FIG. 2 may be selectively used at locations where the opposite flap cannot be used because of obstacles at this track shoulder.

Figure 4:
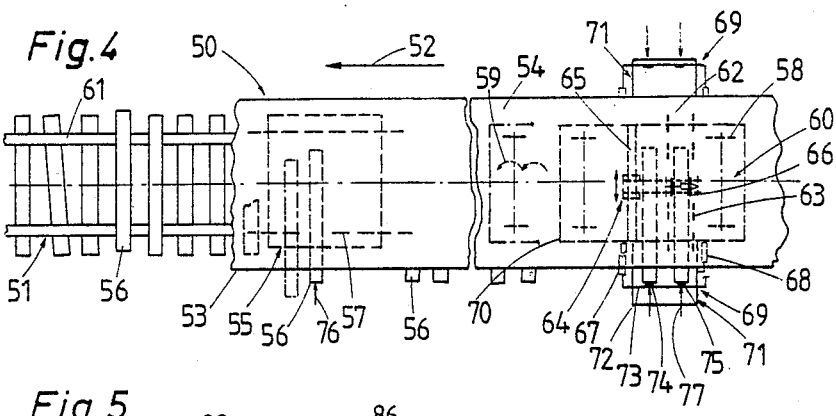
FIG. 4 is a schematic top view of a continuously advancing installation for successively exchanging selected ties along a railroad track and incorporating an intermittently advancing machine according to FIGS. 1 to 3.

FIG. 4 schematically illustrates a small portion of a train 50 consisting of a succession of work vehicles for the successive partial exchange of ties or groups of, for example, two ties of a railroad track 51 while two or three ties therebetween remain in place to maintain the track in operating condition for supporting the train advancing therealong. Such a mobile tie gang apparatus has been described, for example, in U.S. patent application Ser. No. 165,539, filed Mar. 8, 1988, of which the present inventor is a joint inventor. A last work vehicle 54 of train 50, which has a bridge-like machine frame, carries tie insertion device 55 in an upwardly recessed portion of the machine frame. The vertically adjustable tie insertion device is arranged for gripping and transversely displacing ties placed on track 51 and is longitudinally displaceable along guides 57 on the underside of the recessed machine frame portion so that train 50 may advance continuously along the track in the direction indicated by arrow 52 while tie insertion device 55 is operated. Mobile ballast tamping machine 60 of a type illustrated in FIGS. 1 to 3 follows at a distance from tie insertion device 55 and is supported in the upwardly recessed portion of the bridge-like machine frame of work vehicle 54 on railroad track 51 by undercarriages 58 for independent intermittent advancement in the direction of arrows 59. The ballast tamping machine has vertically adjustable ballast tamping assemblies 62 associated respectively with rails 61 of the track. The tamping assemblies have pairs of tamping tools 63 and first tie gripping and positioning device 64 equivalent to device 18 is mounted between the ballast tamping tools for positioning ties 56, device 64 being transversely displaceable along transverse guides 65 and carrying tie positioning griping tongs 66, all equivalent to the structure described hereinabove in connection with FIGS. 1 to 3. Also equivalent, ballast tamping machine 60 has second vertically and transversely displaceable tie positioning device 69. This device, like device 26, has pivotal flap 71 at one side of machine frame 70 and the flap comprises U-shaped carrier frame 72 and transversely displaceable intermediate frame 73 connected to longitudinal displacement drives 67 for displacing the intermediate frame in a direction parallel to the ties. Two pivotal contact pressure plates 74, 75 are mounted on the intermediate frame of the pivotal flap and these pivotal plates arranged for pressure contact with an end face of a tie are spaced in the direction of railroad track 51 by an average distance between successive ties 5. With such a wide carrier frame and intermediate frame holding two tie end engaging plates, it is possible to displace two adjacent ties simultaneously in a single push. Subsequently, these two transversely displaced ties may be correctly positioned by first tie positioning device 64 and the correctly positioned ties are then tamped.

For example, two adjacent ties 56 were withdrawn from track 51 by a tie withdrawal device on a forward work vehicle of train 50 (not shown) while the train advanced continuously along the track. At the points of the withdrawn ties, new ties have been laid on track rails 61. As tie insertion device 55 reaches these new ties 56 upon the continuous advance of train 50, the ties are gripped by device 55 and inserted a short distance into track 51, as indicated by short arrow 76. During the tie insertion and as the train continues to advance, device 55 will be longitudinally displaced along guides 57 and, after the tie insertion stroke has been completed, device 55 will be driven back into its forward end position to be ready for the next tie insertion. In a second tie insertion stage, this partially inserted tie will then be pushed further into the track by the transverse displacement of plates 74, 75 engaging the tie end faces. For this purpose, longitudinal displacement drives 67 of second tie positioning device 69 on tamping machine 60 are actuated to displace intermediate frame 73 with plates 74, 75 in the direction of arrows 77. During this tie insertion stage, ballast tamping machine 60 remains stationary on the track while bridge-like machine frame 53 of work vehicle 54 continuously advances. Finally, in a third tie positioning stage, first the rear tie and then, after a short forward movement of machine 60, the succeeding tie are correctly positioned by gripping them successively by tongs 66 of positioning device 64. After the tie insertion and positioning has thus been completed, the correctly positioned ties are tamped. Ballast tamping machine 60 is then rapidly advanced by its own drive into a forward end position indicated in dash-dotted lines in FIG. 4 to be ready for insertion, positioning and tamping of the next group of two ties 56.

When machine 60 reaches an obliquely positioned tie 56 (see next to last tie to the left in FIG. 4), this tie is gripped by positioning tongs 66 and thus is automatically oriented parallel to the adjacent ties. In this manner, tamping machine 60 is capable not only of completing a tie insertion operation started by tie insertion device 55 but also to correct the position of existing ties remaining in the track.

Figure 5:
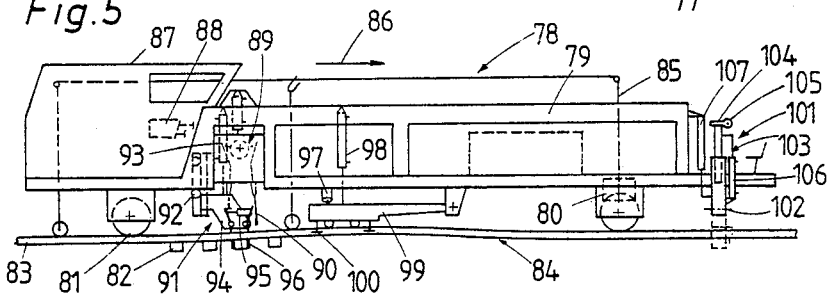
FIG. 5 is a schematic side elevational view of another embodiment of a track leveling, lining and tamping machine with a first tie positioning device associated with the ballast tamping assemblies and a second tie positioning device arranged at the front end of the machine.

FIG. 5 schematically illustrates track leveling, lining and tamping machine 78 with an elongated bridge-like machine frame 79 supported by undercarriages 81 on railroad track 84 consisting of rails 83 fastened to ties 82. The machine has its own drive 80 and carries reference system 85 controlling leveling and lining of the track. The operating direction of the machine is indicated by arrow 86 and operator's cab 87 with a central control station 88 is supported on the rear end of machine frame 79, vertically adjustable ballast tamping assembly associated with each rail 83 being arranged on the machine frame forwardly of cab 87 within view of the operator in the cab. Ballast tamping assembly 89 comprises pairs of vibratory and reciprocatory ballast tamping tools 90 and first tie gripping and positioning device 91 is arranged between the two ballast tamping assemblies. The tie gripping and positioning device is transversely displaceable along transverse guides 92 and is vertically adjustable by drives 93. It has a cantilevered carrier frame 94 for tie positioning tongs 96 which may be pivoted into a tie gripping position by drive 95. Transversely and vertically adjustable track lifting and lining unit 99 is mounted on the machine frame immediately ahead of ballast tamping assemblies 89 with their tie positioning device 91, and this unit comprises laterally adjustable rail lifting rollers 100 for gripping the track rails.

A second transverse tie displacement device 101 for positioning ties 82 is mounted on a cantilevered front end of the machine frame. Device 101 comprises flap 103 mounted at one side of the machine frame and pivotal about axis 102 extending in the direction of railroad track 84. The pivotal flap is comprised of a carrier frame which may be telescopingly extended transversely to the track and carries a contact pressure plate 104 for engagement with an end face of a respective tie. Tie orienting tool 105 is affixed to plate 104. Drive 106 is connected to the carrier frame for extending the same in a direction parallel to the ties. Hydraulically operated cylinder-piston drive 107 connects flap 103 to the machine frame for pivoting the flap about axis 102.

Track leveling, lining and tamping machine 78 enables track 84 to be fully rehabilitated not only by leveling, lining and tamping the track but also with respect to any rehabilitation of damaged and/or mispositioned ties. Any obliquely positioned or displaced ties 82 observed by the operator in rear cab 87 are gripped by tie positioning device 91 and thereby oriented to assume the correct position, in which they are immediately fixed by tamping with ballast tamping assemblies 89. Occasional damaged ties encountered along the track and no longer usable can be transversely withdrawn from track 84 by second tie positioning device 101 at the front of the machine, which is then operated in reverse in the above-indicated manner to insert a new tie in the track. Upon further advance of machine 78 in the direction indicated by arrow 86, the new tie is then leveled, lined and tamped with the same machine.

What is claimed is:

1. In a mobile machine for tamping ballast under ties of a railroad track, each of the ties having opposite longitudinal sides extending transversely to the track, which comprises a machine frame, spaced undercarriages supporting the machine frame for mobility on the railroad track in an operating direction, and a ballast tamping assembly mounted on the machine frame and comprising a vertically adjustable tamping tool carrier, a drive for vertically adjusting the tamping tool carrier, pairs of vibratory and reciprocatory tamping tools immersible in the ballast upon vertical adjustment of the tamping tool carrier and defining a transversely extending plane of symmetry therebetween, and drives for vibrating and reciprocating the tamping tools; the combination of (a) a first device associated with the ballast tamping assembly for gripping and transversely positioning a respective one of the ties, the first device including
  (1) a drive for vertically adjusting the device and
  (2) pivotally adjustable tongs for gripping the longitudinal tie sides, and
(b) a second device operable independently of the first device for transversely displacing a respective one of the ties, the second device including
  (1) drive means for vertically and transversely adjusting the second device,
(c) the first and second devices being arranged in the plane of symmetry adjacent a respective one of the tamping tool carriers.

2. In the ballast tamping machine of claim 1, the second device comprising a flap pivotal about an axis extending in the direction of the railroad track and pivoted to a side of the machine frame, and a plate connected to the pivotal flap and arranged for contacting an end face of a respective one of the ties, the drive means for transversely adjusting the second device being a displacement drive for displacing the plate in the longitudinal direction of the ties, and the drive means for vertically adjusting the second device being a power drive connecting the flap to the machine frame for pivoting the flap about said axis.

3. In the ballast tamping machine of claim 1, a vertically adjustable wedge-shaped orienting tool mounted on the second device for transversely orienting obliquely positioned ones of said ties perpendicularly to the track.

4. In the ballast tamping machine of claim 1, the first device comprising a power drive for pivoting the tongs about a horizontal axis extending perpendicularly to the railroad track to grip the longitudinal tie sides and pressure plates at lower ends of the tongs for grippingly contacting the longitudinal tie sides, the pressure plates extending substantially parallel to the horizontal pivoting axis.

5. In a mobile machine for tamping ballast under ties of a railroad track, each of the ties having opposite longitudinal sides extending transversely to the track, which comprises a machine frame, spaced undercarriages supporting the machine frame for mobility on the railroad track in an operating direction, and a ballast tamping assembly mounted on the machine frame and comprising a vertically adjustable tamping tool carrier, a drive for vertically adjusting the tamping tool carrier, pairs of vibratory and reciprocatory tamping tools immersible in the ballast upon vertical adjustment of the tamping tool carrier, and drives for vibrating and reciprocating the tamping tools: the combination of (a) a first device associated with the ballast tamping assembly for gripping and transversely positioning a respective one of the ties, the first device including
  (1) a drive for vertically adjusting the device and
  (2) pivotally adjustable tongs for gripping the longitudinal tie sides, and
(b) a second device operable independently of the first device for transversely displacing a respective one of the ties, the second device including
  (1) a flap pivotal about an axis extending in the direction of the railroad track and arranged along a side of the machine frame, the flap comprising a U-shaped carrier frame having two free leg ends linked to the machine frame at said axis and two guide posts extending perpendicularly to the axis in a plane defined by the carrier frame,
  (2) a power drive connecting the U-shaped carrier frame to the machine frame for pivoting the flap about said axis and thereby to adjust the flap vertically,
  (3) an intermediate frame longitudinally displaceably mounted on the guide posts of the U-shaped carrier frame,
  (4) a plate connected to the intermediate frame and arranged for contacting an end face of a respective one of the ties, and
  (5) a displacement drive connected to the intermediate frame for displacing the intermediate frame and the plate connected thereto in the longitudinal direction of the ties and thereby to adjust the tie end face contacting plate transversely.

6. In the ballast tamping machine of claim 5, the power drive being a hydraulically operated cylinder linking the carrier frame to the machine frame.

7. In the ballast tamping machine of claim 6, the plate being centrally affixed to the intermediate frame and a respective one of the displacement drives being connected to respective ends of the intermediate frame.

8. In the ballast tamping machine of claim 5, the plate being mounted on the intermediate frame pivotal about an axis extending in the direction of the railroad track.

9. In the ballast tamping machine of claim 8, two of said pivotal plates being mounted on the intermediate frame of the pivotal flap, the pivotal plates being spaced in the direction of the railroad track by an average distance between successive ones of said ties.

10. In the ballast tamping machine of claim 5, a vertically adjustable wedge-shaped orienting tool mounted on the intermediate frame of the pivotal flap for transversely orienting obliquely positioned ones of said ties perpendicularly to the track.

11. In a mobile machine for tamping ballast under ties of a railroad track, each of the ties having opposite longitudinal sides extending transversely to the track, which comprises a machine frame, spaced undercarriages supporting the machine frame for mobility on the railroad track in an operating direction, and a respective ballast tamping assembly associated with a respective rail of the track, the ballast tamping assemblies being mounted on the machine frame and each ballast tamping assembly comprising a vertically adjustable tamping tool carrier, a drive for vertically adjusting the tamping tool carrier, pairs of vibratory and reciprocatory tamping tools immersible in the ballast upon vertical adjustment of the tamping tool carrier, the ballast tamping assemblies defining a transversely extending plane of symmetry between the pairs of tamping tools, and drives for vibrating and reciprocating the tamping tools: the combination of (a) a first device associated with the ballast tamping assemblies for gripping and transversely positioning a respective one of the ties, the first device including
  (1) a drive for vertically adjusting the device and
  (2) pivotally adjustable tongs for gripping the longitudinal tie sides, and
(b) a second device operable independently of the first device for transversely displacing a respective one of the ties, the second device including
  (1) drive means for vertically and transversely adjusting the second device,
(c) the first and second devices being arranged in the plane of symmetry adjacent a respective one of the tamping tool carriers.

12. In the ballast tamping machine of claim 11, each second device comprising a flap pivotal about an axis extending in the direction of the railroad track and pivoted to a respective side of the machine frame, and a plate connected to the pivotal flap and arranged for contacting a respective end face of a respective one of the ties, the drive means for transversely adjusting the second device being a displacement drive for displacing the plate in the longitudinal direction of the ties, and the drive means for vertically adjusting the second device being a power drive connecting the flap to the machine frame for pivoting the flap independently about said axis.

13. In the ballast tamping machine of claim 11, the first device being arranged in said plane of symmetry between the tamping tool carriers of the ballast tamping assemblies and a respective one of the second devices being arranged in said plane of symmetry at each side of the machine frame.

14. In the ballast tamping machine of claim 11, the pivotal flaps at the opposite sides of the machine frame being arranged symmetrically with respect to the ballast tamping assemblies and the first device.

* * * * *